US011801880B2

(12) United States Patent
Su et al.

(10) Patent No.: US 11,801,880 B2
(45) Date of Patent: Oct. 31, 2023

(54) OPERATION ADJUSTMENT METHOD AND SYSTEM FOR METRO TRAIN IN UNIDIRECTIONAL JAM

(71) Applicant: Beijing Jiaotong University, Beijing (CN)

(72) Inventors: Shuai Su, Beijing (CN); Junqing Liu, Beijing (CN); Zhikai Wang, Beijing (CN); Boyi Su, Beijing (CN)

(73) Assignee: BEIJING JIAOTONG UNIVERSITY, Beijing (CN)

( * ) Notice: Subject to any disclaimer, the term of this patent is extended or adjusted under 35 U.S.C. 154(b) by 16 days.

(21) Appl. No.: 17/636,520

(22) PCT Filed: Jun. 11, 2021

(86) PCT No.: PCT/CN2021/099677
§ 371 (c)(1),
(2) Date: Feb. 18, 2022

(87) PCT Pub. No.: WO2022/147963
PCT Pub. Date: Jul. 14, 2022

(65) Prior Publication Data

US 2023/0159071 A1 May 25, 2023

(30) Foreign Application Priority Data

Jan. 7, 2021 (CN) ..... 202110018437.8

(51) Int. Cl.
*B61L 27/04* (2006.01)
*B61L 25/02* (2006.01)

(52) U.S. Cl.
CPC ..... *B61L 27/04* (2013.01); *B61L 25/023* (2013.01)

(58) Field of Classification Search
CPC ..... B61L 27/04; B61L 25/023
See application file for complete search history.

(56) References Cited

U.S. PATENT DOCUMENTS 11,702,120 B2 * 7/2023 Otsuki ..... B61L 27/12 701/19
2018/0111633 A1 4/2018 Abrosimov et al.
(Continued)

FOREIGN PATENT DOCUMENTS

CN 102730028 A 10/2012
CN 102842219 A * 12/2012
(Continued)

*Primary Examiner* — Peter D Nolan
*Assistant Examiner* — Demetra R Smith-Stewart
(74) *Attorney, Agent, or Firm* — COATS & BENNETT, PLLC

(57) ABSTRACT

The present disclosure provides an operation adjustment method for a metro train in a unidirectional jam, including: generating a train operation routing scheme in the jam according to a jam position; setting priorities for turnaround stations; determining an affected train set; predicting, according to the affected train set, arrival times of each affected train at the turnaround stations of the different priorities; determining, according to the time, planned train service to be executed by the affected train after turning around; and acquiring a planned train service canceled during the jam, and allocating, according to the planned train service canceled during the jam, a train resource for train addition or storage. The present disclosure avoid the conventional complicated operation of manually determining the affected train one by one, and reasonably adds the extra passenger train to arrive at the station on the line for passenger carrying.

9 Claims, 9 Drawing Sheets

(56) References Cited

U.S. PATENT DOCUMENTS

| | | | | |
|---|---|---|---|---|
| 2019/0318253 | A1 | 10/2019 | Maekawa et al. | |
| 2020/0391775 | A1* | 12/2020 | Otsuki ..... | G06Q 10/0631 |

FOREIGN PATENT DOCUMENTS

| | | | |
|---|---|---|---|
| CN | 105912815 | A | 8/2016 |
| CN | 108372871 | A | 8/2018 |
| CN | 112693505 | A | 4/2021 |

* cited by examiner

OPERATION ADJUSTMENT METHOD AND SYSTEM FOR METRO TRAIN IN UNIDIRECTIONAL JAM

CROSS REFERENCE TO RELATED APPLICATION

The present application is a national stage of International Application No. PCT/CN2021/099677, filed on Jun. 11, 2021, which claims priority to the Chinese Patent Application No. 202110018437.8, filed with the China National Intellectual Property Administration (CNIPA) on Jan. 7, 2021, and entitled "OPERATION ADJUSTMENT METHOD AND SYSTEM FOR METRO TRAIN IN UNIDIRECTIONAL JAM". Both of the aforementioned applications are incorporated herein by reference in their entireties.

TECHNICAL FIELD

The present disclosure relates to the field of train operation control and organization, and in particular, to an operation adjustment method and system for a metro train in a unidirectional jam.

BACKGROUND ART

Metro in China is booming, and there have been developed metro networks in large cities such as Beijing, Shanghai and Guangzhou. The metro is of importance to improve the urban transportation capacity and relieve the traffic pressure. However, in case of faults or emergencies during operation, trains cannot normally run as scheduled, the carrying capacities of lines are reduced, and perhaps the carrying capacities in partial areas are greatly reduced or even the operation is interrupted, all of which seriously affect the normal operation order and the quality of service (QoS) for passengers.

As a core for operation organization of metro trains, metro dispatchers are required to make a quick response for the faults or emergencies to reduce influences on the train operation, and ensure that the trains can return to normal running quickly and orderly upon fault recovery. One typical and important fault is the unidirectional jam mainly arising from track breakage and foreign matter intrusion at a position on the lines, and any segment with the unidirectional jam is unallowable for the trains to pass through. In this scenario, the dispatchers will manually adjust the train operation according to jam information, and send commands to affected trains one by one through telephones, to implement a series of complex adjustments such as train detaining, train reducing, rerouting and midway turnaround. With large labor intensity, the dispatchers are likely to make operational errors in emergencies and hard to ensure the effectiveness and efficiency of adjustments. Hence, there is an urgent need to adjust the train operation automatically and intelligently. With the rapid development of the metro, reducing the influences of the faults and emergencies on the train operation, improving the QoS of the metro and relieving working pressures of the dispatchers are of great concern in transportation services of the metro.

Therefore, it is desirable to provide an intelligent operation adjustment scheme for a metro train in a unidirectional jam.

SUMMARY

An objective of the present disclosure is to provide an operation adjustment method and system for a metro train in a unidirectional jam, to automatically generate an intelligent operation adjustment scheme for the metro train in the jam.

To implement the above objectives, the present disclosure provides the following solutions:

An operation adjustment method for a metro train in a unidirectional jam includes:

acquiring a jam position and a jam time;

generating a train operation routing scheme in the jam according to the jam position;

setting priorities for turnaround stations on a routing according to the train operation routing scheme, wherein the turnaround stations each are a turnaround supporting station, a turnaround station away from an origin station has a high priority, and a turnaround station close to the origin station has a low priority;

generating an affected train set upon occurrence of the jam according to the jam position and the jam time;

predicting, according to the affected train set, arrival times of each affected train at the turnaround stations of the different priorities;

determining, according to the arrival times of each affected train at the turnaround stations, planned train service to be executed by the affected train after turning around; and acquiring a quantity of planned train service canceled during the jam, and allocating, according to the quantity of planned train service canceled during the jam, a train resource for train addition or storage.

Optionally, the generating a train operation routing scheme in the jam according to the jam position may specifically include:

searching an available train running routing on two sides of the jam position according to the jam position and line topology information, the line topology information being information on a station position and a corresponding layout; and determining the train operation routing scheme according to the available train running routing, the train operation routing scheme comprising two cases, which are a case where two sides of the jam position each are provided with a running routing, and a case where only one side of the jam position is provided with the running routing, and an other side does not form the running routing.

Optionally, the turnaround supporting station refers to a station enabling a train to switch terminals of the train and change a running direction;

a turnaround type comprises a midway turnaround and a terminal turnaround; the midway turnaround refers to a turnaround at an intermediate station; and the terminal turnaround refers to a turnaround at the destination station; and a turnaround mode may include a platform-front turnaround and a platform-behind turnaround.

Optionally, the predicting, according to the affected train set, arrival times of each affected train at the turnaround stations of the different priorities may specifically include:

predicting the arrival times of each affected train at the turnaround stations, according to basic information of each affected train including a present position, a velocity, a tractive force and a braking force, by using a section minimum running time model.

Optionally, the determining, according to the arrival times of each affected train at the turnaround stations, planned train service to be executed by the affected train after turning around may specifically include:

determining, planned train service that are executed by the affected train in a present departure condition, by comparing a first time after the affected train arriving at a turnaround station on a preset routing and performing a normal turnaround with a time of a planned train service after the first time.

Optionally, after the determining, according to the arrival times of each affected train at the turnaround stations, planned train service to be executed by the affected train after turning around, the method may further includes:

scheduling the affected train to perform an midway turnaround at a station of a lower priority to execute another planned train service, when the affected train does not execute a planned train service in an affected train number set after turning around at a turnaround station of a highest priority.

Optionally, after the generating a train operation routing scheme in the jam according to the jam position, the method further includes a step of processing a train on a non-routing line without the train operation routing scheme:

determining a detaining position of the train on the non-routing line;

calculating a departure interval of an extra passenger train according to the jam position and the line topology information; and running the extra passenger train to arrive at a station on the line, where a routing is not formed, for passenger carrying.

An operation adjustment system for a metro train in a unidirectional jam includes:

an information acquiring unit, configured to acquire a jam position and a jam time;

a routing operation scheme generating unit, configured to generate a train operation routing scheme in the jam according to the jam position;

a priority determining unit, configured to set priorities for turnaround stations on a routing according to the train operation routing scheme, wherein the turnaround stations each are a turnaround supporting station, a turnaround station away from an origin station has a high priority, and a turnaround station close to the origin station has a low priority;

an affected train set generating unit, configured to generate an affected train set upon occurrence of the jam according to the jam position and the jam time;

a time predicting unit, configured to predict, according to the affected train set, arrival times of each affected train at the turnaround stations of the different priorities;

a planned train service determining unit, configured to determine, according to the arrival times of each affected train at the turnaround stations, planned train service to be executed by the affected train after turning around; and a train resource allocating unit, configured to acquire a quantity of planned train service canceled during the jam, and allocate, according to the quantity of planned train service canceled during the jam, a train resource for train addition or storage.

Optionally, the operation adjustment system may further include: a train midway turnaround control unit, configured to:

schedule the affected train to perform an midway turnaround at a station of a lower priority to execute another planned train service, when the affected train does not execute a planned train service in an affected train number set after turning around at a turnaround station of a highest priority.

Optionally, the operation adjustment system may further include:

a detaining position determining unit, configured to determine a detaining position of a train on a non-routing line;

an extra passenger train departure interval control unit, configured to calculate a departure interval of an extra passenger train according to the jam position and a line topology information; and an extra passenger train running control unit, configured to run the extra passenger train to arrive at a station on the line, where a routing is not formed, for passenger carrying.

Based on specific embodiments provided in the present disclosure, the present disclosure has the following technical effects:

1. At the beginning of the jam, the present disclosure uses the intelligent method to replace the method that the dispatcher manually determines the train operation routing scheme in the unidirectional jam, and avoid the conventional complicated operation of manually determining the affected train one by one.
2. In the process of the jam, the present disclosure intelligently determines the train detaining position on the metro line without the running routing, and makes the train clear the passengers at the station as much as possible, thereby preventing the adverse effect of unloading passenger in sections. Meanwhile, the present disclosure calculates the departure interval with information such as the line topology and the station type, and reasonably adds the extra passenger train to arrive at the station on the line for passenger carrying, thereby preventing a phenomenon that a great number of passengers are stranded due to no trains to serve for a long time, and improving the QoS for the passengers as much as possible.
3. Upon the recovery of the jam, the present disclosure automatically allocates the train resource with the depot or the storage line of the station, which greatly reduces the complicated and frequent operation on the trains in dispatch and command process of trains.

BRIEF DESCRIPTION OF THE DRAWINGS

The present disclosure will be further described below with reference to the accompanying drawings.

REFERENCE NUMERALS

Figure 1:
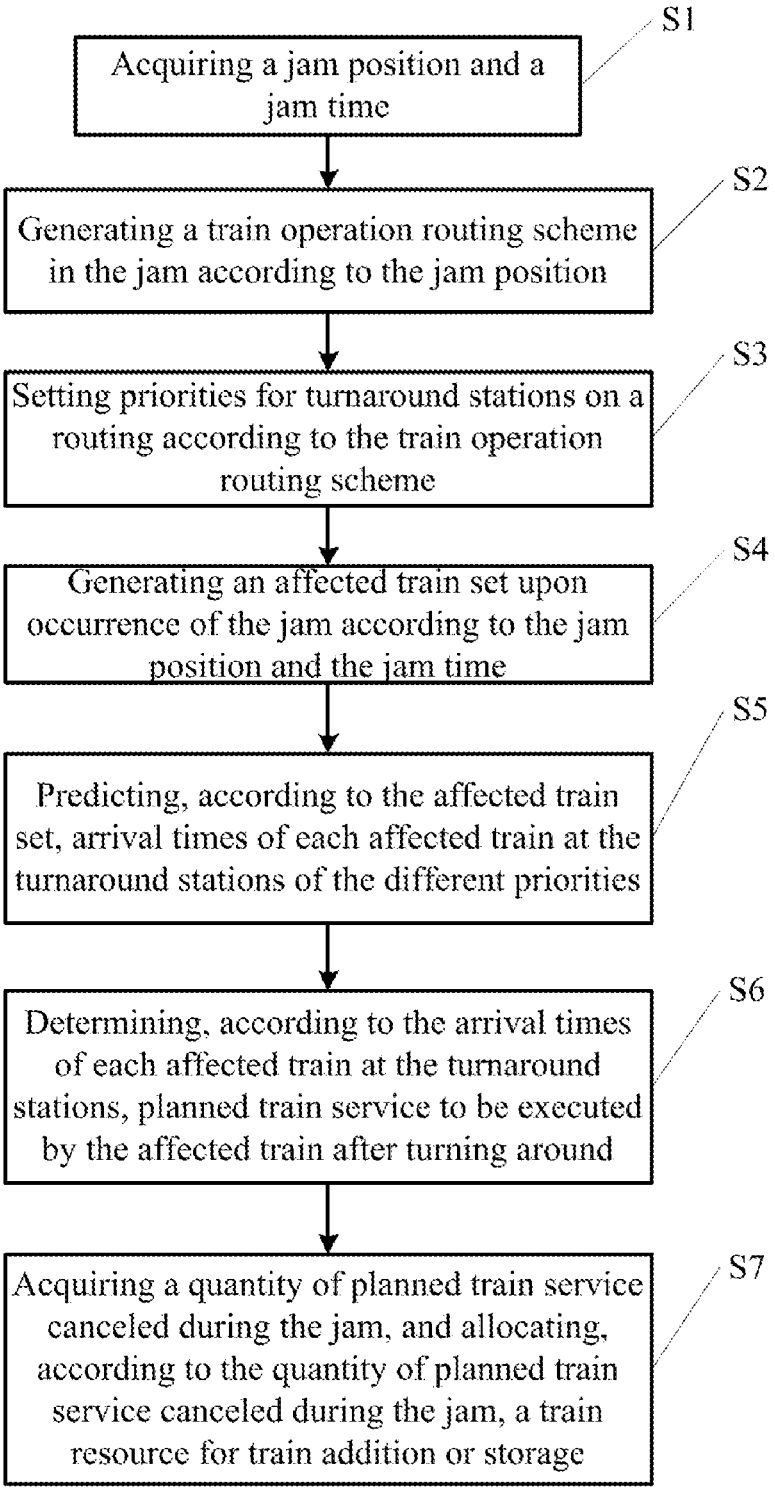
FIG. 1 is a control flow chart of an operation adjustment method for a metro train in a unidirectional jam according to Embodiment 1 of the present disclosure.

M1. information acquiring unit, M2. routing operation scheme generating unit, M3. priority determining unit, M4. affected train set generating unit, M5. time predicting unit, M6. planned train service determining unit, and M7. train resource allocating unit.

DETAILED DESCRIPTION OF THE EMBODIMENTS

The technical solutions in the embodiments of the present disclosure are clearly and completely described below with reference to the accompanying drawings. Apparently, the described embodiments are merely a part rather than all of the embodiments of the present disclosure. All other embodiments obtained by a person of ordinary skill in the art on the basis of the embodiments of the present disclosure without creative efforts shall fall within the protection scope of the present disclosure.

An objective of the present disclosure is to provide an operation adjustment method and system for a metro train in a unidirectional jam, to automatically generate an intelligent operation adjustment scheme for the metro train in the jam.

In the operation of the metro, trains cannot pass through a position where the unidirectional jam such as the track breakage and foreign matter intrusion occurs. In order to prevent further propagation of fault impact, the dispatchers will determine a train operation routing scheme in the jam according to the position of the jam segment and in combination with information such as the line topology and the station type, such that trains running to the turnaround station on each routing turns around, thereby reducing influences of the jam segment on the operation. Presently, the dispatchers determine the train operation scheme in the jam mainly by manually analyzing information such as the jam position and the line topology to make decisions, and this process is not automatic and intelligent. Once the dispatchers cannot handle the fault timely and reasonably, the fault is likely to be aggravated.

Furthermore, according to running states (including the positions and the velocities) of up and down trains, the dispatchers will frequently predict the arrival time of the trains at the turnaround stations on each routing, and then determine planned train service to be launched after the trains return. With the rising travel demands of the passengers, both the traffic density of the metro system and the labor intensity of the dispatchers are increased.

In addition, if a line on one side of the jam position cannot form the train running routing, the dispatchers will manually determine the train detaining positions according to running states (including the positions and the velocities) of the trains on the line upon occurrence of the jam and in combination with the information such as the line topology, such that the trains clear the passengers at station platforms as much as possible, thereby reducing the influences of the jam on the passengers. Meanwhile, in order to prevent the phenomenon that there are no trains passing through the stations on the line for a long time, the dispatchers will add extra passenger trains according to the line topology and the train running positions, and run the trains to arrive at the stations for passenger carrying. The above process requires the dispatchers to have the emergency handling experience and emergency response capabilities.

At last, in order to ensure that the trains can recover normal running upon the end of the jam, the dispatchers will add or store the train manually with the depot or the storage line of the station, and this often cannot implement the reasonable allocation of the train resources.

To sum up, existing operation adjustment methods for the metro train in the unidirectional jam have the following defects:

1. Upon the occurrence of the jam, the dispatchers will manually determine the train operation routing scheme in the jam according to the jam position and in combination with information such as the line topology and the station type, such that the fault handling efficiency is low.
2. The dispatchers will frequently predict the arrival time of the trains at the turnaround stations according to real-time positions and velocities of the trains, and determine planned train service to be launched after the trains return, so the labor intensity of the dispatchers is large.
3. In case of a line where the train running routing cannot be formed during the jam, the dispatchers will manually adjust the positions of the trains in the line. Meanwhile, in order to prevent the phenomenon that there are no trains passing through the stations on the line for a long time and a large number of passengers are stranded, the dispatchers will run trains to the stations according to the line topology and the station types as much as possible for passenger carrying. This imposes higher requirements on the emergency response capabilities and emergency handling experience of the dispatchers.
4. Upon the recovery of the jam, the dispatchers will manually allocate the train resources, namely sending dispatching commands to add or store the train with the depot or the train storage line of the station, and this often cannot implement efficient utilization of the train resources.

To make the above objectives, features, and advantages of the present disclosure clearer and more comprehensible, the present disclosure will be further described in detail below with reference to the accompanying drawings and the specific examples.

Embodiment 1

As shown in FIG. 1, an operation adjustment method for a metro train in a unidirectional jam provided by Embodiment 1 of the present disclosure specifically includes the following steps.

In step S1, a jam position and a jam time are acquired.

Information such as line topology and station types are stored, and in case of the unidirectional jam, the jam position is acquired timely and the jam time is determined. The unidirectional jam refers to that an emergency occurs on a position of the metro line in a certain direction, such that trains cannot normally run to the planned destination through the position. Generally, the unidirectional jam is arising from track breakage, foreign matter intrusion, etc.

In step S2, a train operation routing scheme in the jam is generated according to the jam position, specifically:

An available train running routing on two sides of the jam position is searched according to the jam position and line topology information, the line topology information is information on a station position and types of corresponding layout lines.

The train operation routing scheme is determined according to the available train running routing, the train operation routing scheme including two cases, namely a case where two sides of the jam position each are provided with an running routing, and a case where only one side of the jam position is provided with the running routing, and the other side can not form the running routing.

Figure 2:
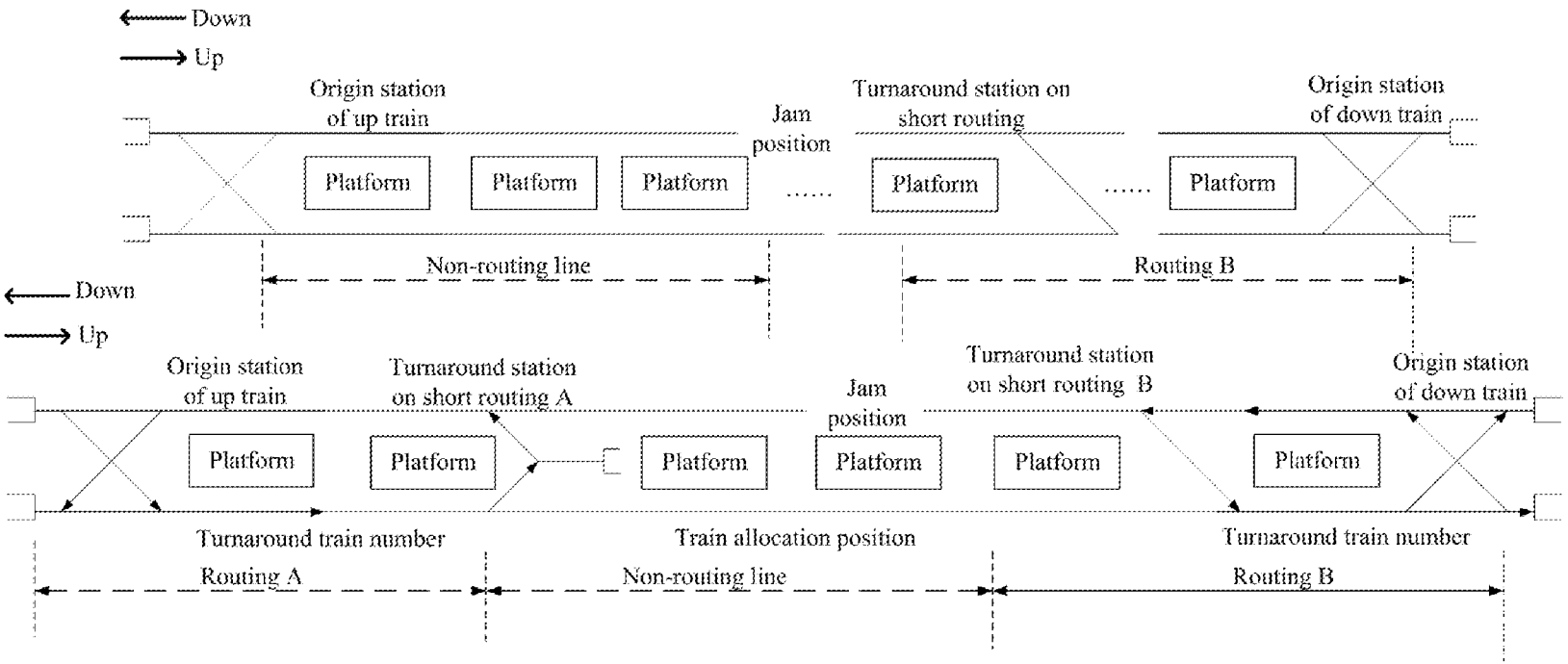
FIG. 2 is a schematic view of a train operation routing scheme generated in the operation adjustment method for a metro train in a unidirectional jam according to Embodiment 1 of the present disclosure.

The line topology information of metro mainly includes station positions and types of corresponding layout lines. The station type mainly refers to whether turnaround lines are provided and how many train storage lines are provided at the stations. For example, there are station-front single turnaround lines, station-front double turnaround lines, station-behind single turnaround lines, station-behind double turnaround lines, etc. Generating the train operation routing scheme in the jam is mainly to determine whether the available train running routing is provided on two sides of the jam position according to the jam position and the line topology information. As shown in FIG. 2, the generated train operation routing scheme includes two cases: (1) two sides of the jam position each are provided with the running routing; and (2) only one side of the jam position is provided with the running routing, and the other side can not form the running routing.

The specific implementation steps are as follows.

In step S21, it is assumed that a metro line includes N stations, with a set of stations $S=\{1, 2, \ldots, k, \ldots N\}$ k being a $k_{th}$ station. Based on the jam position on the line, track sections (including station tracks) and turnouts on two side lines of the jam position are abstracted as nodes according to information on line topology, station positions and turnout positions, with a set of nodes $V=\{v_1, v_2, \ldots v_n, \ldots v_{|V|}\}$, where $v_n$ represents an $n_{th}$ node in the V, and |V| represents a quantity of nodes in the set V; and further, each node is provided with an attribute tag, including a station node tag $F_{v_n,k}^{station}$ and a turnout node tag $F_{v_n,k}^{turnaround}$ for platform-front turnaround. A function $k=f(v_n)$, $k\in S$, $v_n\in V$ is defined, representing a mapping relation between the node $v_n$ and the station k, where $$F_{v_n,k}^{station}=\begin{cases}1, & \text{node } v_n \text{ is the station track node of the station } k\\ 0, & \text{node } v_n \text{ is not the station track node of the station } k\end{cases}$$

$$F_{v_n,k}^{turnaround}=\begin{cases}1, & \text{node } v_n \text{ is the turnout node for station-front turnaround of the station } k\\ 0, & \text{node } v_n \text{ is not the turnout node for station-front turnaround of the station } k\end{cases}$$

$$F_{v_n,k}^{station}+F_{v_n,k}^{turnaround}\leq 1,\ \forall\, v_n\in V,\ k\in S.$$

Figure 3:
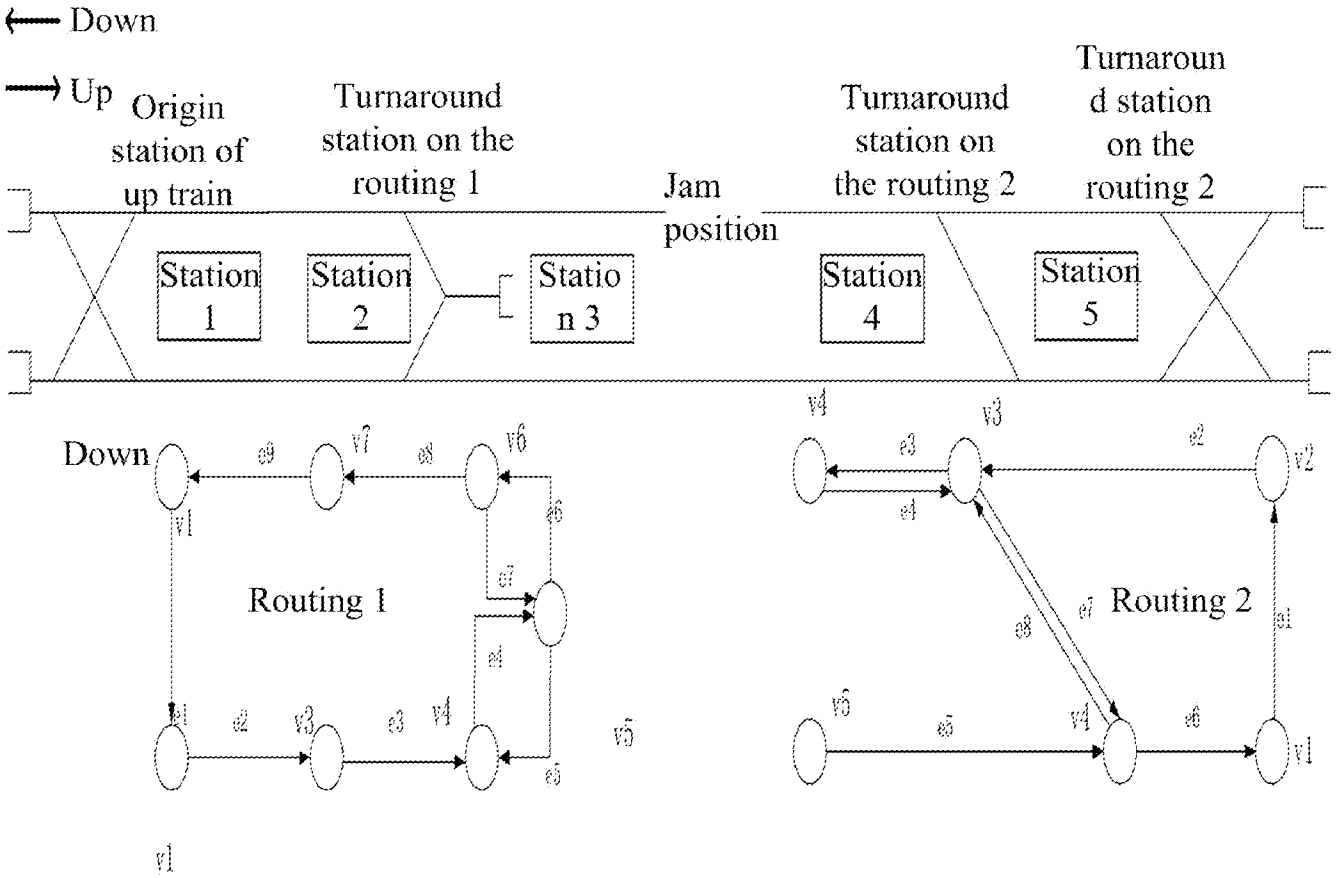
FIG. 3 is a schematic view of a track node and a turnout node generated in the operation adjustment method for a metro train in a unidirectional jam according to Embodiment 1 of the present disclosure.

As shown in FIG. 3, the nodes $v_1$ $v_2$ on the routing 1 are track nodes of the station 1, then $f(v)=1$, $f(v_2)=1$ and $F_{v_1,1}^{station}=1$, $F_{v_2,1}^{station}=1$; and the node $v_3$ on the routing 2 is a turnout node for platform-front turnaround of the station 4, then $f(v_3)=4$ and $F_{v_3,4}^{turnaround}=1$.

In step S22, a connection relation between the nodes is set according to a running direction of the train and a direction of the turnout on the line, such that two directed graphs $G_1=(V_1, E_1)$, $G_2=(V_2, E_2)$ can be respectively generated, where $V_1,V_2$ are sets $V_1,V_2\subseteq V$ composed of nodes in the graphs, and $E_1$, $E_2$ are sets composed of directed edges, $E_1$, $E_2\subseteq E$. Each directed graph can generate an adjacency matrix. With the $G_1$ as an example, the adjacency matrix $A_1=(a_{i,j})_{|V_1|\times|V_1|}$ is used to represent a connection relation between nodes in the $G_1$, where J are row and column indexes of the matrix, the adjacency matrix $A_1$ represents a relation between nodes in the graph $G_1$, for example, if the first node and the second node are connected in the graph, then $a_{1,2}=1$, and $|V_1|$ is a quantity of nodes in the graph:

$$a_{i,j}=\begin{cases}1, & v_{i,j}\in E_1\\ 0, & v_{i,j}\notin E_1\end{cases}.$$

In the above expression, $v_{i,j}$ represents a directed edge with nodes $v_i$, $v_j$ as endpoints, $v_j$, $v_j\in V_1$.

A bidirectional connection relation is provided between the turnout for the platform-front turnaround on the line and the platform track, and other nodes are connected according to the running direction of the train. For simplicity of the model, at origin stations, such as the station 1 and the station 5 in FIG. 3, track nodes in up and down directions may be directly connected according to the running direction of the train, regardless of the double turnaround line.

Moreover, for ease of description, the following definitions are provided:

1. The routing including the origin station in the up direction is an up routing, as shown by the routing 1 in FIG. 2. On the contrary, the routing including the origin station in the down direction is a down routing, as shown by the routing 2 in FIG. 3.
2. The train running in a direction same as that of the routing is a forward train on the routing; and as shown in FIG. 2, the up train running on the routing 1 is defined as the forward train on the routing. On the contrary, the train running in a direction reverse to that of the routing is a reverse train on the routing; and as shown in FIG. 2, the down train running on the routing 1 is defined as the reverse train on the routing.
3. The forward trains on the routing are formed into a forward train set on the routing; and likewise, the reverse trains on the routing are formed into a reverse train set on the routing.

In step S23, a circle is searched in each of the two directed graphs $G_1$ and $G_2$. With the graph $G_1$ as an example, there is a circle set $R=\{r_1, r_2, \ldots, r_u, \ldots r_{|R|}\}$, where $r_u=(V_u^R, E_u^R)$, $V_u^R\subseteq V_1$, $E_u^R\subseteq E_1$, V1 being a set composed of nodes in the circle and $E_1$ being a set composed of directed edges in the circle, and $$V_u^R=\left\{v_{u_1}^R, v_{u_2}^R, \ldots v_{u_a}^R, \ldots v_{u_{|V_u^R|}}^R\right\},$$

$V_{u_a}^R$ being a node index in the set $V_u^R$, $V_1$ being a node set of the $G_1$, and $E_1$ being a directed edge set of the $G_1$. If the circle set R=Ø, Step S2 is ended; or otherwise, for a circle $r_u\in R$, nodes in the circle are traversed to find a station having a maximum subscript or a turnout node for the platform-front turnaround, namely:

$$k = \max f(v_{u_a}^R),\ F_{v_{u_a}^R, f(v_{u_a}^R)}^{station} + F_{v_{u_a}^R, f(v_{u_a}^R)}^{turnaround} = 1,\ v_{u_a}^R \in V_u^R$$

Therefore, the turnaround station k in the circle and the turnaround mode of the train at this station are determined. In other words, if the node having the maximum subscript is the station track node, the turnaround mode of the train at the station is the platform-behind turnaround, $T_k^{forward}=1$, or otherwise, is the platform-front turnaround, $T_k^{forward}=0$, namely:

$$T_k^{forward} = \begin{cases} 1, & F_{n,k}^{station} = 1 \\ 0, & F_{n,k}^{turnaround} = 1 \end{cases}.$$

Finally, the turnaround station set $T_{circle}^{turnaround}$ of the directed graph G=(V,E) is output, where the circle means a loop. The set is traversed to find a maximum subscript value of the turnaround station in all circles, namely:

$$K=\max\{k|,k\in T_{circle}^{turnaround}\},K\in S$$

Therefore, the routing $C_K$ with the station K as the terminal turnaround station is output, K being the turnaround station having the maximum subscript.

In step S24, the train operation routing scheme generated in Step S22 can be divided into two cases: (1) two sides of the jam position each are provided with the train running routing; and (2) only one side of the jam position is provided with the train running routing, and the other side can not form the running routing.

In step S3, priorities are set for turnaround stations on a routing according to the train operation routing scheme, where the turnaround stations each are a turnaround supporting station, a turnaround station away from an origin station has a high priority, and a turnaround station close to the origin station has a low priority.

The turnaround supporting station refers to a station enabling a train to switch its terminals and change a running direction, and a train turnaround type includes an midway turnaround and a terminal turnaround. The midway turnaround is a turnaround at an intermediate station; and the terminal turnaround is a turnaround at the destination station. A turnaround mode includes a platform-front turnaround and a platform-behind turnaround. According to the train operation routing scheme, the turnaround station of the high priority is the turnaround station away from the origin station, while the turnaround station of the low priority is the turnaround station close to the origin station.

The stations in the set $T_{Circle}^{turnaround}$ are prioritized according to distances from the origin station, where the station of the high priority is the station away from the origin station, while the station of the low priority is the station close to the origin station.

In step S4, an affected train set upon occurrence of the jam is generated according to the jam position and the jam time.

The affected train set on the line includes affected trains on a line having the running routing and affected trains on a non-routing line where the running routing cannot be formed.

The trains on the non-routing line will be detained and its detaining positions will be determined. The detaining positions are determined according to states of stations as well as positions and velocities of the trains on the line where the running routing cannot be formed upon the occurrence of the jam, and are reasonably allocated to the trains when the jam occurs. In order to prevent the phenomenon that a great number of passengers are stranded at some stations because there are no trains for a long time upon the occurrence of the jam, extra passenger trains will be run to arrive at the stations for passenger carrying. Departure intervals of the extra passenger trains are calculated according to the jam position and the topological line information to keep arrival time of the extra passenger trains at the stations uniform as much as possible. The extra passenger trains are then run to arrive at the stations on the line, where the routing cannot be formed, for passenger carrying. Now, the specific implementation step E is described.

The following steps are continuously performed on the trains following the train operation routing scheme.

Figure 4:
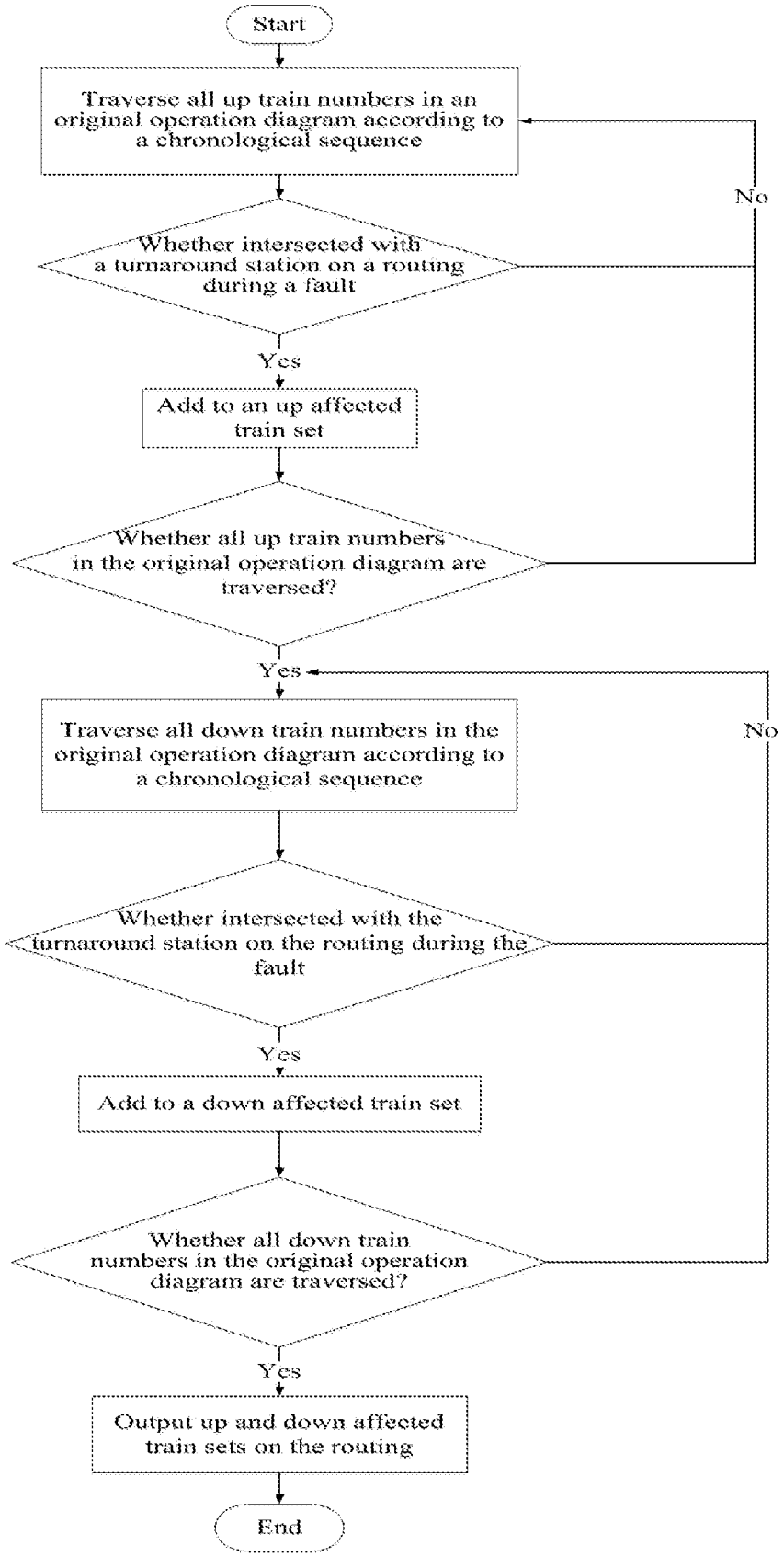
FIG. 4 is a control flow chart for determining affected train set generated in the operation adjustment method for a metro train in a unidirectional jam according to Embodiment 1 of the present disclosure.

With a routing $C_K$ in the train operation routing scheme generated in step S2 as an example, as shown in FIG. 4, step S4 specifically includes the following steps.

In step S41, all planned train service in a planned operation diagram are sorted according to departure time to generate an up planned train service set $T_{up}^{plan}$ and a down planned train service set $T_{down}^{plan}$. According to start and end time of the jam, all planned train service running lines intersected with a turnaround station K of the routing $C_K$ during the jam are searched, and added to the affected up train number set $T_{up}^{circle}$ of the routing $C_K$. Specifically, supposing that arrival time of the train $i_{up}^{plan}$, $i_{up}^{plan}\in T_{up}^{plan}$ at the turnaround station of the routing is $$t_{i_{up}^{plan}}^K,$$

if the $$t_{i_{up}^{plan}}^K$$

meets a condition:

$$t_0 \le t_{i_{up}^{plan}}^K \le t_0 + t_d,$$

then, it can be determined that the train is affected by the fault, $t_0$, $t_d$ are start time and time of duration of the jam respectively.

Meanwhile, whether the train departs before the start time of the jam is determined according to departure time of the planned train service; and the train is tagged as a departed train number if yes; or otherwise, as a waiting train number if no. Elements in the set $T_{up}^{circle}$ are sorted according to departure time.

Likewise, train numbers in the set $T_{down}^{plan}$ are traversed. If the running line of a down planned train service is intersected with a turnaround station on a short routing during the jam, the train number is added to the affected down train number set $T_{down}^{circle}$ of the corresponding routing; and meanwhile, the train is tagged to indicate whether it have departed and elements in the $T_{down}^{circle}$ are sorted.

In addition, letting departure times of first up and down train numbers passing through the jam segment be $t_{up}^{jam}$, $t_{down}^{jam}$ upon the occurrence of the jam, and departure time of first up and down train numbers passing through the jam segment be $t_{up}^{recovery}$, $t_{down}^{recovery}$ upon recovery of the jam, and supposing that departure time of train numbers $i_{down}^{plan} \in T_{down}^{plan}$, $i_{up}^{plan} \in T_{up}^{plan}$ is $$t_{i_{down}^{plan}}^{depart}, t_{i_{up}^{plan}}^{depart},$$

last up and down train indexes passing through the jam segment before the jam are $I_{up}^{last}$, $I_{down}^{last}$, and first up and down train indexes passing through the jam segment upon the recovery of the jam are $I_{up}^{first}$, $I_{down}^{first}$, where:

$$I_{up}^{last} = \arg\max_{i_{up}^{plan}} \left(t_{i_{up}^{plan}}^{depart}\right), t_{i_{up}^{plan}}^{depart} \le t_{up}^{jam}, i_{up}^{plan} \in T_{up}^{plan}$$

$$I_{down}^{last} = \arg\max_{i_{down}^{plan}} \left(t_{i_{down}^{plan}}^{depart}\right), t_{i_{down}^{plan}}^{depart} \le t_{down}^{jam}, i_{down}^{plan} \in T_{down}^{plan}$$

$$I_{up}^{first} = \arg\min_{i_{up}^{plan}} \left(t_{i_{up}^{plan}}^{depart}\right), t_{i_{up}^{plan}}^{depart} \ge t_{up}^{recovery}, i_{up}^{plan} \in T_{up}^{plan}$$

$$I_{down}^{first} = \arg\min_{i_{down}^{plan}} \left(t_{i_{down}^{plan}}^{depart}\right), t_{i_{down}^{plan}}^{depart} \ge t_{down}^{recovery}, i_{down}^{plan} \in T_{down}^{plan}$$

In step S42, all planned train service in up and down directions are traversed, and a train running line intersected with the station on the line where the train running routing cannot be formed upon the occurrence of the jam is searched, namely, train numbers on the running line are located on the line where the train running routing cannot be formed upon the occurrence of the jam, and are added to the train sets $T_{up}^{line}$, $T_{down}^{line}$ on the line where the train running routing cannot be formed.

In step S5, arrival time of each affected train at the turnaround stations of the different priorities is predicted according to the affected train set.

The arrival time of each affected train at the turnaround stations is predicted according to basic information of each affected train such as a present position, a velocity, a tractive force and a braking force by using a section minimum running time model.

The specific implementation steps are as follows.

In step S51, for each turnaround station $k(k \in T_{Circle}^{turnaround})$, affected train number sets $T_{up}^{circle}$ and $T_{down}^{circle}$ on the routing are respectively traversed; a position $S_{i^c}$ and a running state (including information such as a running velocity $v_{i^c}$ and a present moment $t_0$ of the train executing the train number) of the train number $i^c(i^c \subset T_{up}^{circle} \cup T_{down}^{circle})$ are determined through a communication message between a transponder and an onboard device; and arrival time $t_{i^c,k}$ of the train $i^c$ at the station k is predicted.

In step S52, it is assumed that a section p where a train presently executing the train number $i^c$ is located includes U velocity limit segments 1, 2, . . . , . . . L, l being an index of each velocity limit segment. There are P sections 1, 2, . . . p, . . . P between the train and the front station, p being an index of each section; and the train is running in the velocity limit segment $(s_l^{lim}, s_{l+1}^{lim})$ namely $s_{i^c} \in (s_l^{lim}, s_{l+1}^{lim})$ and the present velocity limit segment has a maximum velocity limit of $v_u^{lim}$. With a destination $s_{l+1}^{lim}$ of the velocity limit segment as an origin, a maximum braking force running curve $v_l^b(s)$ of the train is drawn to obtain a running trajectory of the train and an entry velocity $v_l^{entry}$ of the velocity limit segment. If there is an intersection between the maximum braking force running curve and the velocity limit $v_l^{lim}$, $v_l^{entry}$ is equal to the velocity limit; and if there is no intersection, the $v_l^{entry}$ is the equal to the entry velocity of the maximum braking force running curve, which is indicated as $$v_l^{entry} = \begin{cases} v_l^{limit}, & \text{if } v_l^{limit} \le v_l^b(s_l^{lim}) \\ v_l^b(s_l^{lim}), & \text{others} \end{cases}$$

From the present velocity point of the train, for each velocity limit segment, a the smaller of the velocity limit $v_l^{limit}$ and the entry velocity $v_l^{entry}$ in the present segment is obtained, to draw running curve $v_l^h(s)$ corresponding to the maximum traction force of the train:

$$v_l^h(s_l^{lim}) = \begin{cases} v_l^{limit}, & \text{if } v_l^{limit} \le v_l^{entry} \\ v_l^{entry}, & \text{others} \end{cases}.$$

A minimum velocities obtained at various positions are compared, and the running curve of the train is connected, i.e.:

$$v_l(s) = \min\{v_l^h(s), v_l^b(s), v_l^{limit}\}.$$

Therefore, a minimum running time $t_{i^c}^{run}$ of the train in the section may be indicated as:

$$t_{i^c}^{run} = \sum_{l=1}^{L} \int_{s_l^{lim}}^{s_{l+1}^{lim}} \frac{1}{v_l(s)} ds$$

Time $t_{i^c,k}$ that the train executing the train number $i^c$ arrives at the station k may be indicated as:

$$t_{i^c,k} = t_0 + \sum_{p=1}^{P} t_{i^c,p}^{run}.$$

In step S6, a planned train service to be executed by the affected train after turning around is determined according to the arrival time of each affected train at the turnaround stations.

A planned train service that can be executed by the affected train in a present departure condition is determined by comparing time immediately after the affected train arriving at a turnaround station on a preset routing and performing a normal turnaround, with time of a planned train service thereafter.

When the affected train cannot execute a planned train service in an affected train number set after turning around at a turnaround station of a highest priority, the affected train is scheduled to perform an midway turnaround at a station of a lower priority to execute other planned train service that may be canceled, thereby reducing the quantity of suspended train numbers.

Further, with a routing in the up direction as an example, Step S6 includes the following specific implementation steps.

In step S61, for any affected train number $i_{up}^c$, $i_{up}^c \in T_{up}^{circle}$, namely the forward train and the turnaround station $k \in T_{Circle}^{turnaround}$ on the routing, minimum time after the train turns around at the station k can be calculated according to the predicted time $$t_{i_{up},k}^{c}$$

that the train executing the train number $i_{up}^{c}$ arrives at the station k in Step S5, and shortest turnaround time $r_k^{min}$ and passenger clearing time cl determined by a turnaround condition of the station k $$t'_{i_{up},k}^{c} = t_{i_{up},k}^{c} + cl + r_k^{min}.$$

In step S62, the down affected train number set is traversed circularly, and according to the predicted arrival time $t_{i_{down}^{c},k}$ of the down affected train number $i_{down}^{c}$, $i_{down}^{c} \in T_{down}^{circle}$ at the station k in Step S5, it is determined whether the train running the train number $i_{up}^{c}$ can execute the planned train service $i_{down}^{c}$ after turning around at the station k. If $$t_{i_{down},k}^{c} \geq t'_{i_{up},k}^{c},$$

the train $i_{up}^{c}$ executes the planned train service $i_{down}^{c}$ after turning around, the planned train service $i_{down}^{c}$, $i_{up}^{c}$ are removed from the affected train number set, and the planned train service $i_{up}^{c}$ is added to the set $T_{up}^{decide}$. If $$t_{i_{down},k}^{c} < t'_{i_{up},k}^{c},$$

a next round of circulation is performed continuously. If a train number meeting the condition cannot be searched in the down affected train number set and the train $i_{up}^{c}$ does not depart when the jam occurs, the planned train service $i_{up}^{c}$ is canceled and added to an up canceling set $T_{up}^{cancel}$. Upon the completion of the circulation, remaining elements in the $T_{down}^{circle}$ will not be replaced by rolling stocks for running.

Each train number will be provided with one rolling stock for running. When the jam occurs, since the down train cannot pass through the jam position, train numbers in the down direction cannot be run by the rolling stocks. In this case, rolling stocks in the up direction must turn around at an intermediate station to run the train numbers in the down direction. Therefore in Step S62, the rolling stocks in the up direction turn around to run the train numbers in the down direction. However, there still remains some train numbers in the down direction that cannot be run by the rolling stocks in the up direction, so remaining elements in the set are all suspended train numbers.

In step S63, according to a detaining principle, a detaining command is sent to a follow-up train of the train executing the train number $i_{up}^{c}$, detaining time is set according to a turnaround mode at the turnaround station. In other words, if the turnaround mode of the train at the turnaround station on the routing is the platform-front turnaround, the follow-up train is detained at a rear station, until the train runs away from a turnout segment where the turnout for the platform-front turnaround is located. If the turnaround mode of the train at the turnaround station is the platform-behind turnaround, the follow-up train is detained at a rear station, until that the train runs away from the platform track of the turnaround station. In addition, if there is a train detained at the front station when the train executing the train number $i_{up}^{c}$ departs, the planned train service is canceled; and the train number $i_{up}^{c}$ is added to the canceling train number set $T_{up}^{cancel}$, or otherwise, the planned train service departs lately at the origin station.

In step S64, if the other side of the jam segment is also provided with the train running routing, steps S61-S63 are repeated, or otherwise, step E is performed.

Figure 5:
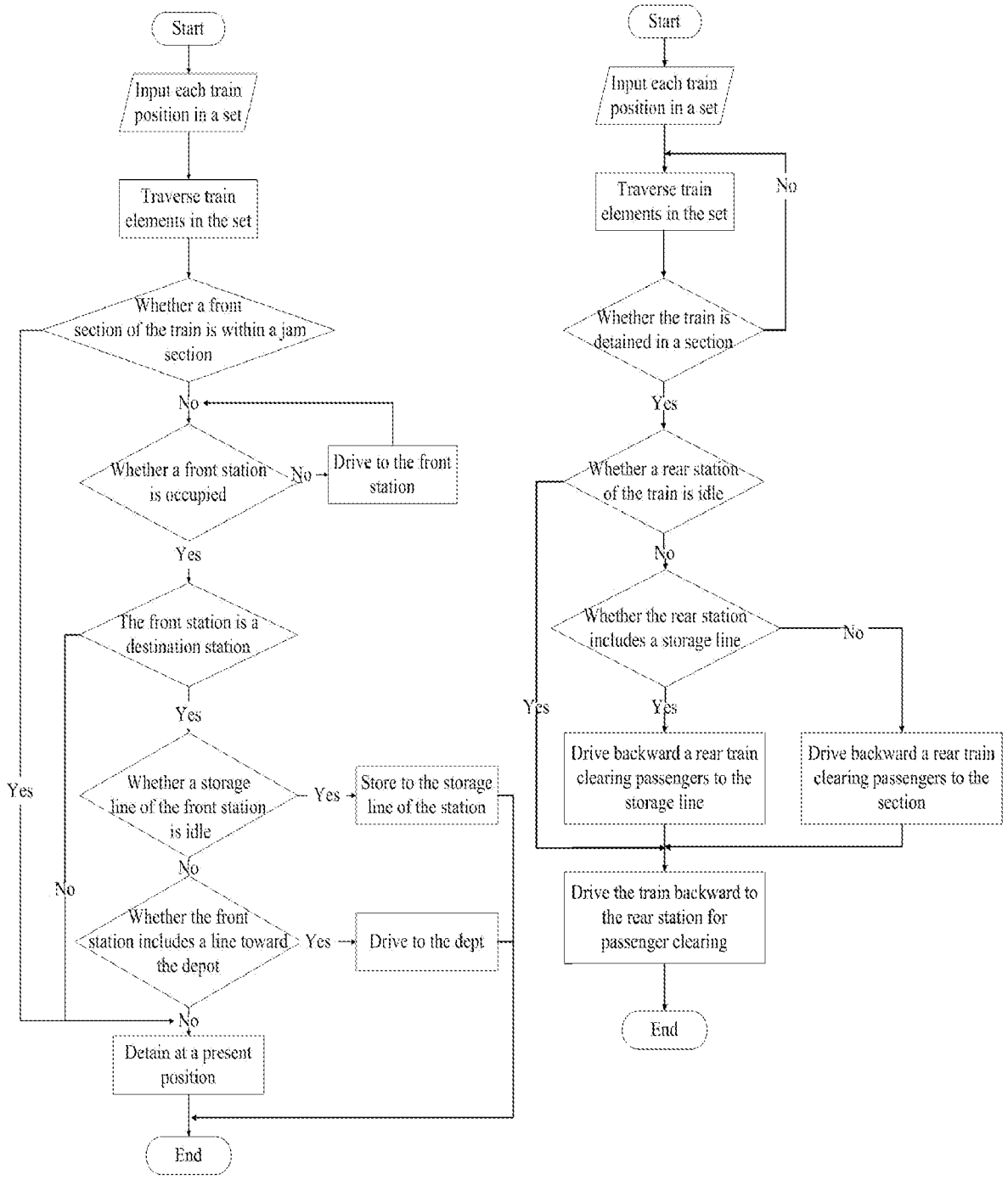
FIG. 5 is a control flow chart for determining a train detaining position and launching an extra passenger train in the operation adjustment method for a metro train in a unidirectional jam according to Embodiment 1 of the present disclosure.

As shown in FIG. 5, step E includes the following specific implementation steps.

In step E.1, the affected train number sets $T_{up}^{line}$, $T_{down}^{line}$ generated in Step S42 are traversed to acquire a present position of each train in the sets. If the jam line does not exist between the present position of the train and the front nearest station, whether a front station is idle is further determined, or otherwise, a detaining command is sent to the train such that the train is detained at the present position. Supposing that $i^{line}$ is the index of the set $T_{up}^{line} \cup T_{down}^{line}$, the state of the train is defined as:

$$S_i = (F_{i^{line}}, T_{i^{line}}, D_i^{line}) i^{line} \in T_{up}^{line} \cup T_{down}^{line}$$

Where $$F_{i^{line}} = \begin{cases} 0, \text{ the front station of the train } i^{line} \text{ is not occupied} \\ 1, \text{ the front station of the train } i^{line} \text{ is occupied} \end{cases}$$

$$T_{i^{line}} = \begin{cases} 0, \text{ the front station of the train } i^{line} \text{ is not the turnaround station} \\ 1, \text{ the front station of the train } i^{line} \text{ is the turnaround station} \end{cases}$$

$$D_{i^{line}} = \begin{cases} 0, \text{ the front station of the train } i^{line} \text{ is not the destination station} \\ 1, \text{ the front station of the train } i^{line} \text{ is the destination station} \end{cases}$$

In step E2, as shown by the left part in FIG. 5, whether the front station of the train is occupied by other train is determined; and if the front station is occupied and is not the destination station, a detaining command is sent to the train such that the train is detained at the present position. If the front station is occupied and is the destination station, whether a storage line of the destination station is idle is further determined, the train at the destination station being often stored at platforms in up and down directions, a storage place of a turnaround line, etc.; and if the storage line is idle, the train is driven to the storage line of the station. If the storage line is full, whether the station has a line toward the depot is determined continuously; and if the train can be driven to the depot, the train is driven to the depot; or otherwise, the train is detained at the present position. If the front station is idle, the present train is continuously driven forward.

Figure 6:
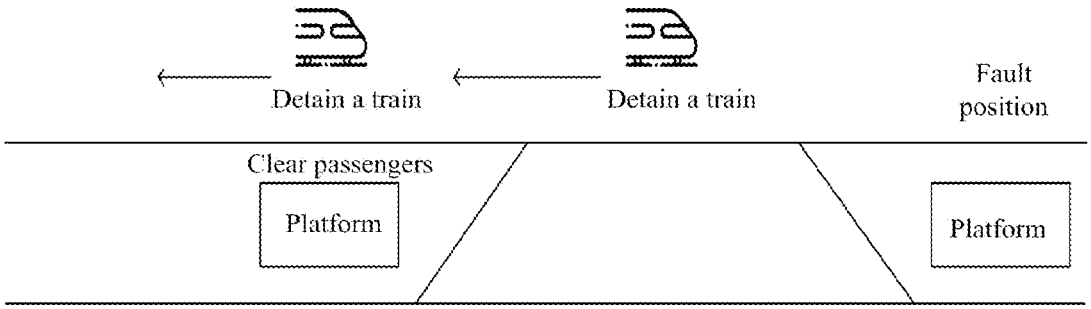
FIG. 6 is a schematic view for determining whether a rear station is idle and controlling backward driving of a train in the operation adjustment method for a metro train in a unidirectional jam according to Embodiment 1 of the present disclosure.

In step E3, $T_{up}^{line}$, $T_{down}^{line}$ are traversed to reacquire positions of trains executing the train numbers in the sets. If a train is being detained in a section now, the train number is added to a train position adjustment set $T^{adjust}$. As shown by the right part in FIG. 5, for the train number $i^{adjust} \in T^{adjust}$, whether a rear station is idle is determined. If the rear station is idle, the train executing the train number is driven backward to the rear station and clears passengers on the platform of the rear station. If the rear station is occupied by a train, the train at the rear station clears passengers and then is driven backward to the storage place such as storage line at the station or in the section, and then the present train is driven backward to the rear station platform to clear the passengers, as shown in FIG. 6.

In step E4, train numbers in the sets $T_{up}^{line}$, $T_{down}^{line}$ are traversed. If the present position of the train executing the train number is located at the destination station, the train number is added to the set $T_{turning}^{line}$, or otherwise, is added to the sets $T_{station}^{up}$, $T_{station}^{down}$ according to the running direction of the train and sorted according to the departure time.

In step E5, first planned train service $\alpha_{up}^{1}$,$\alpha_{down}^{1}$ passing through the jam segment in the up and down directions upon the recovery of the jam are respectively searched according to indexes $I_{up}^{first}$, $I_{down}^{first}$ output in Step S4. Last train numbers $\beta_{up}^{last}$,$\beta_{down}^{last}$ passing through the jam segment in the up and down directions before the jam are searched according to indexes $I_{up}^{last}$,$I_{down}^{last}$. Supposing that the jam occurs at a position on the up line, trains can still normally pass through the down line. Supposing that an extra passenger train set is $T^{temp}$, and an extra passenger train index is $i^{temp}$, departure interval $t^{interval}$ of the extra passenger train can be calculated according to the following equation:

$$t^{interval}=\alpha_{down}^{1}-\beta_{down}^{last}.$$

Further, the quantity $N_{store}$ of stored trains at the destination station in the down direction, including platforms and storage lines in the up and down directions, is calculated. The departure interval $t^{depart}$ of the extra passenger train is calculated:

$$t^{depart}=t^{interval}/(N_{store}+1)$$

The arrival time $t_{i^{temp}}^{temp}$ of the extra passenger train $i^{temp}$ at the destination station is:

$$t_{i^{temp}}^{temp} = t_{\alpha_{down}^{1}}^{arrive} + t^{depart} * i^{temp},\ i^{temp} = 1, 2, \ldots, N_{store}$$

E6: For the train number $i_{down}^{decide} \in T_{down}^{decide}$, supposing that the arrival time at the turnaround station on the routing is $$t_{i_{down}^{decide}}^{predict},$$

and the running time from the turnaround station on the routing to the destination station is $t^{run}$, the train number i* of the extra passenger train to be run can be calculated as:

$$i^* = \arg\min_{i_{down}^{decide}}\left(\left|t_{i_{down}^{decide}}^{predict} + t^{run} - t_{i^{temp}}^{temp}\right|\right),\ t^{temp} = 1, 2, \ldots, N_{store}.$$

The train number i* is removed from the set $T_{down}^{decide}$, the planned train service to be executed after the train number i* turning around at the turnaround station on the routing is added to the suspended set, and the train running the train number i* runs to the destination station in the down direction for passenger carrying.

Figure 7:
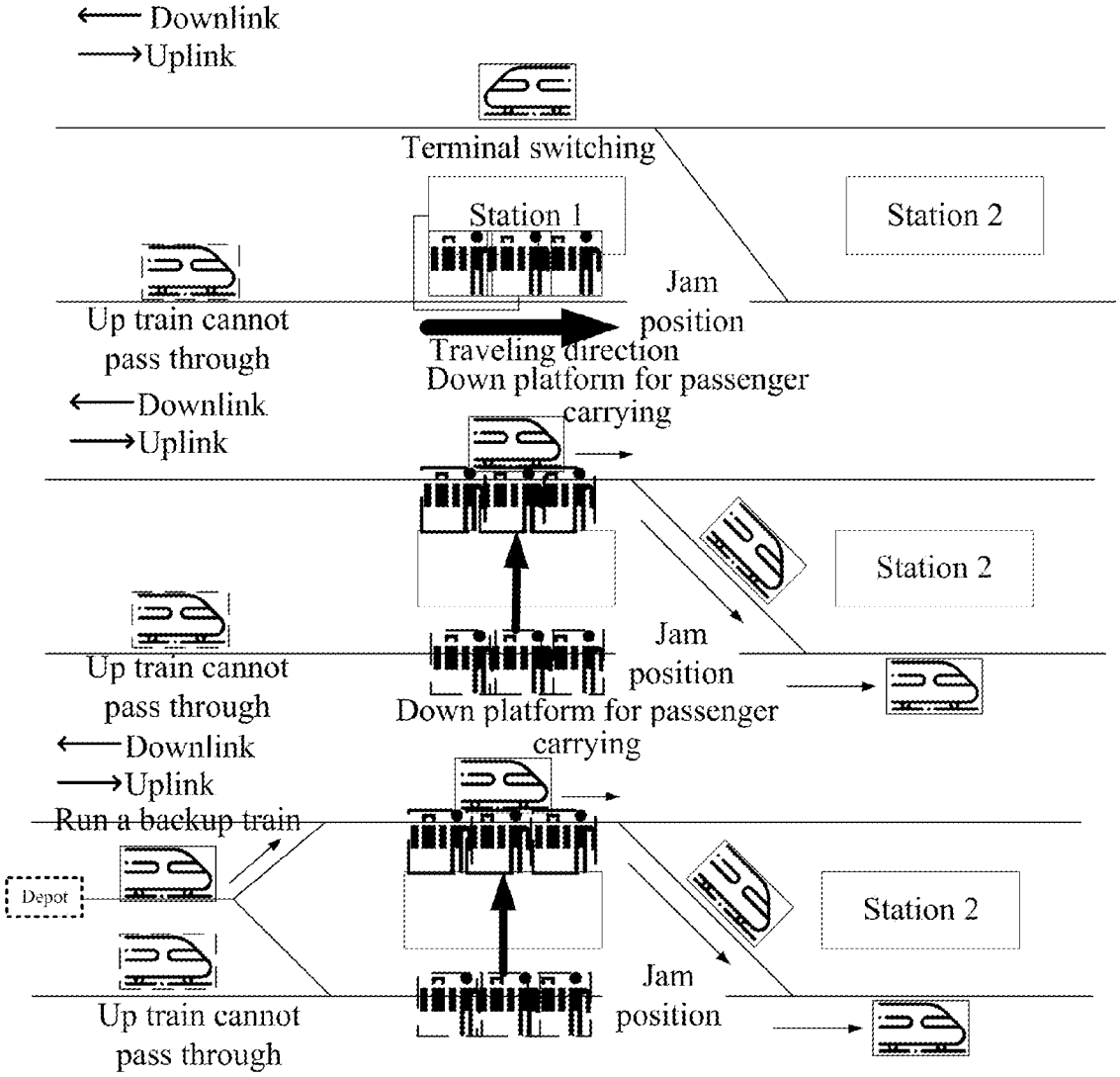
FIG. 7 is a schematic view for launching the extra passenger train for carrying passenger in the operation adjustment method for a metro train in a unidirectional jam according to Embodiment 1 of the present disclosure.

In step E7, for a station in the up direction without trains passing through for a long time, the extra passenger train can be run to the station according to the line topology and the platform arrangement, including island platforms and side platforms, for passenger carrying. As shown in FIG. 7, since the jam occurs on the up line between the station 1 and the station 2, a great number of passengers going to the up direction are stranded at the platform of the station 1. According to the station type, there are the following two cases: If the station 1 cannot store the train, the down train performs passenger clearing and terminal switching on the down platform of the station 1. The worker at the station 1 is then notified to organize the passengers going to the up direction to take the train on the down platform. The train carries the passengers on the down platform of the station 1, and carries the passengers to the up line through the turnout on the crossover. If the station 1 can store the train or is connected to the depot, and there is the backup train on the storage line or in the depot, the backup train can be directly run from the depot or the storage line to arrive at the down platform, and the backup train carries the passengers going to the up direction, on the down platform.

In step S7, a quantity of planned train service canceled during the jam is acquired, and upon the recovery of the jam, a train resource is allocated according to the quantity of planned train service canceled during the jam, for train addition or storage. The planned train service which has been canceled refers to a planned train service that cannot be run according to the planned operation diagram, including a planned train service that must be canceled according to the detaining principle, a planned train service that cannot be run by the rolling stock during the jam, and a planned train service for which a corresponding train meeting the condition cannot be found after turning around at a station on the short routing. Train addition refers to increasing the number of trains in service. Train addition is to add the train through the depot or the storage line of the station to execute the planned train service without the rolling stock, thereby recovering normal operation of the train system by the end of the jam.

The specific implementation steps are as follows.

In step S71, in order to recover normal operation quickly by the end of the jam, a train addition set and a train storage set are respectively defined in the up and down directions. With the up direction as an example, the train addition set $T_{add}$ and the train storage set $T_{store}$ are defined. It is assumed that planned turnaround times of the train at destination stations in the up and down directions are $t_{up}^{ori}$,$t_{up}^{des}$ respectively. The sets $$T_{up}^{recovery} = \left\{a_{up}^{1}, a_{up}^{2}, \ldots a_{up}^{i_{up}^{recovery}}, \ldots a_{up}^{|T_{up}^{recovery}|}\right\} \text{ and}$$

$$T_{down}^{recovery} = \left\{a_{down}^{1}, a_{down}^{2}, \ldots a_{down}^{i_{down}^{recovery}}, \ldots a_{down}^{|T_{down}^{recovery}|}\right\}$$

are defined, where $T_{up}^{recovery}$, $T_{down}^{recovery}$ are respectively up and down planned train service sets not affected upon the recovery of the jam. Since the rolling stocks cannot pass through the jam segment during the jam, train numbers during the jam are inevitably affected, while train numbers upon the recovery of the jam are not affected.

$$a_{up}^{i_{up}^{recovery}} \text{ and } a_{down}^{i_{down}^{recovery}}$$

each are a set index. Where, $$t_{\alpha_{up}^{1}}^{depart} \le t_{a_{up}^{i_{up}^{recovery}}}^{depart} \le t_{\alpha_{down}^{1}}^{arrive} + t_{up}^{ori},\ \forall\, a_{up}^{i_{up}^{recovery}} \in T_{up}^{recovery}$$

-continued $$t^{depart}_{\alpha^1_{down}} \le t^{depart}_{a^{i^{recovery}_{down}}_{down}} \le t^{arrive}_{\alpha^1_{up}} + t^{des}_{up}, \forall a^{i^{recovery}_{down}}_{down} \in T^{recovery}_{down}$$

where, $\alpha_{up}^1$,$\alpha_{down}^1$ are first train indexes passing through the jam segment in the up and down directions by the end of the jam respectively, $$t^{depart}_{a^{i^{recovery}_{up}}_{up}}$$

is departure time of a train number having an index of $$a^{i^{recovery}_{up}}_{up},$$

$t_{up}^{ori}$ is turnaround time of an up origin station, and $t_{up}^{des}$ is turnaround time of an up destination station.

With the routing in the up direction as an example, according to Step S6, remaining elements in the reverse (down) affected train number set on the routing are not executed by the rolling stocks. For the train number $i_{down}^c \in T_{down}^{circle}$, $T_{down}^{circle}$ is the down affected train number set on the routing defined in Step S5, time $$t^{arrive}_{i^c_{down}}$$

that the train executing the train number arrives at the destination is predicted. If $$t^{arrive}_{i^c_{down}}$$

meets:

$$t^{depart}_{\alpha^1_{up}} \le t^{arrive}_{i^c_{down}} + t^{des}_{i^c_{down}} \le t^{depart}_{a^{|T^{recovery}_{up}|}_{up}},$$

the train number $i_{down}^c$ is added to the set $T_{add}$, such that the normal operation can be recovered by the end of the jam, and further, elements in the $T_{add}$ are sorted according to departure time. The canceled train number set $T_{up}^{cancel}$ generated in Step S6 is then traversed circularly to find the planned train service corresponding to each train number element in the set before the turnaround, and the planned train service are added to the train storage set $T_{store}$.

Figure 8:
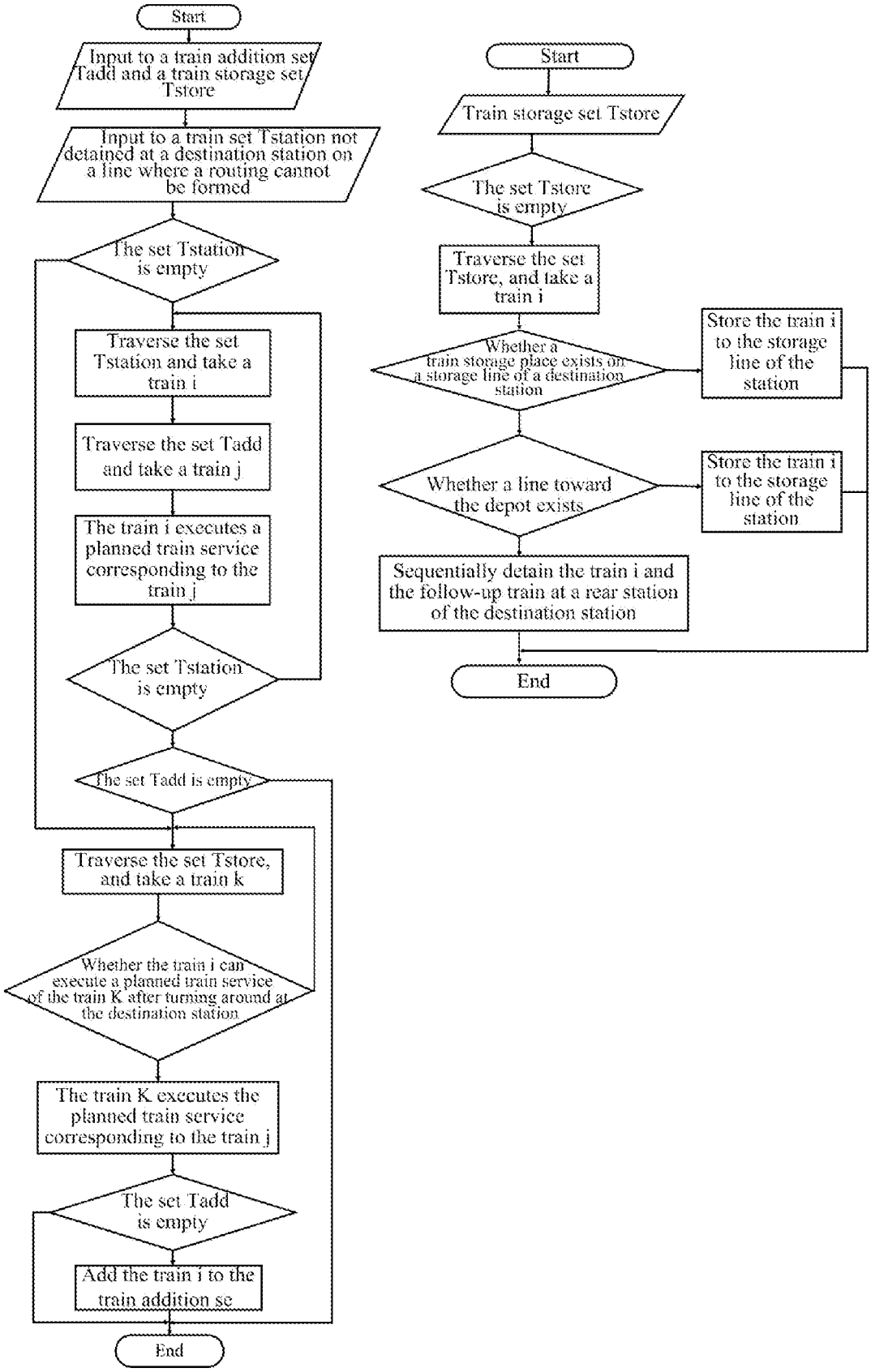
FIG. 8 is a control flow chart for determining a train number not running as planned and accordingly adding or storing a train in the operation adjustment method for a metro train in a unidirectional jam according to Embodiment 1 of the present disclosure.

In step S72, as shown in FIG. 8, the train addition set is traversed. For the planned train service $i^{add}$,$i^{add} \in T_{add}$, if the train operation scheme generated in Step S1 does not include the line which cannot form the running routing or $T_{station}^{up}=\emptyset$, step S73 is directly executed; or otherwise, the $T_{station}^{up}$ is traversed according to Step E, and for the train number $i_{station}^{up} \in T_{station}^{up}$, the train executing the train number runs the planned train service, corresponding to the train number $i^{add}$, at the detaining position, and the trains $i^{add}$,$i_{station}^{up}$ are removed from the set $T_{add}$,$T_{station}^{up}$.

In step S73, for the train number $i^{add}$,$i^{add} \in T_{add}$, whether the set $T_{store}$ is empty is determined. If the set $T_{store}$ is not empty, the set $T_{store}$ is traversed, the train element $i^{store}$, $i^{store} \in T_{store}$ runs the planned train service corresponding to the planned train $i^{add}$, and the trains $i^{add}$,$i^{store}$ are removed from the set $T_{add}$,$T_{store}$. Or otherwise, whether a train can be added through the depot is further determined. If the depot includes a backup train, a dispatching command is sent to move the backup train from the storage to execute the planned train service corresponding to the train $i^{add}$. If the set $T_{add}$ still includes remaining elements, planed train numbers to be executed by the remaining elements after turning around at the destination station are added to the opposition $T^{add}$ set.

In step S74, if the set $T_{store}$ is an empty set, Step S7 is ended; or otherwise, for the train number $i^{store}$,$i^{store} \in T_{store}$, if the quantity of stored trains at the destination station does not reach the train storage limit when the train number $i^{store}$ arrives at the destination station, the train executing the train number $i^{store}$ is directly stored to the storage line; or otherwise, whether the line in the running direction of the train includes a line toward the depot is determined, and the train is driven to the depot if yes, and if no, the train and the follow-up train thereof are sequentially detained at a station behind the destination station, until the turnaround line of the destination station meets the turnaround condition.

Figure 9:
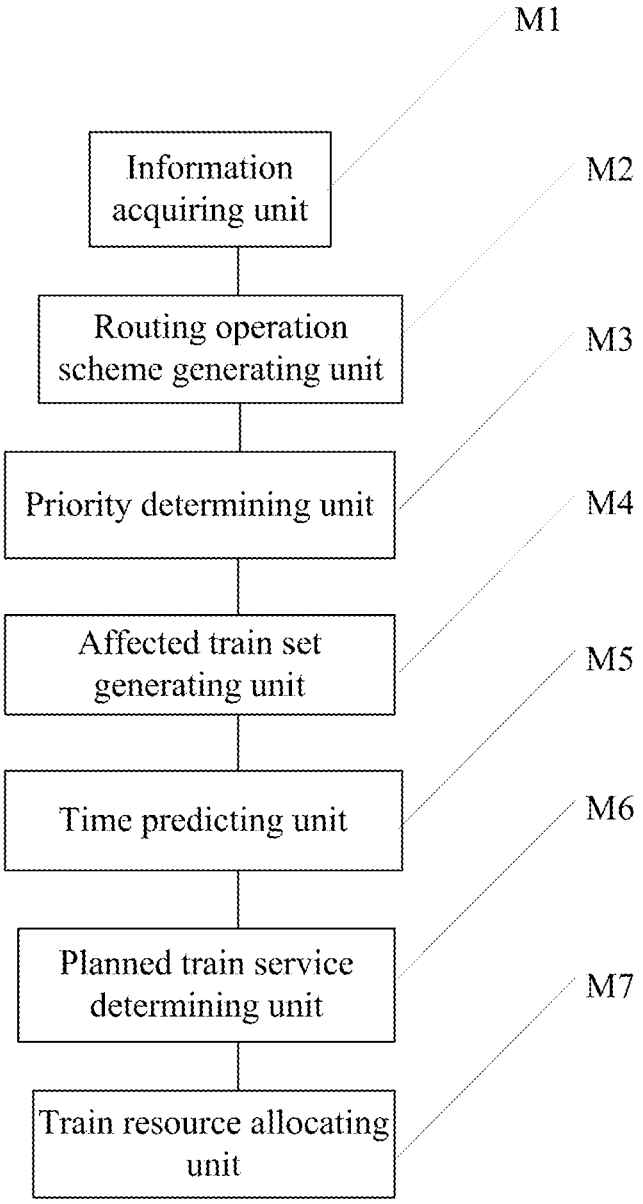
FIG. 9 is a structural block diagram of an operation adjustment system for a metro train in a unidirectional jam according to Embodiment 1 of the present disclosure.

The operation adjustment method for a metro train in a unidirectional jam according to the embodiment of the present disclosure automatically generates the train operation routing scheme in the jam, thereby improving the emergency handling efficiency and relieving the working pressure of the dispatcher. In addition, the present disclosure determines the priorities of the turnaround supporting stations, automatically generates up and down affected train sets in the line according to start and end time of the jam, predicts arrival time of each train in the sets at the turnaround stations of the different priorities, and determines the planned train service to be executed by the train after turning around. Further, in case of a line where the train running routing cannot be formed, the present disclosure acquires positions and other information of the trains on the line, intelligently decides detaining positions of the trains, calculates the departure interval of the extra train, and adds the extra train to arrive at the stations for passenger carrying. Furthermore, upon the recovery of the jam, the present disclosure automatically counts the quantity of up and down added or suspended trains, and schedules the train resources through the depot or the storage line of the station. Referring to FIG. 9, an embodiment of the present disclosure further provides an operation adjustment system for a metro train in a unidirectional jam, including:

- an information acquiring unit M1, configured to acquire a jam position and a jam time;
- a routing operation scheme generating unit M2, configured to generate a train operation routing scheme in the jam according to the jam position;
- a priority determining unit M3, configured to set priorities for turnaround stations on a routing according to the train operation routing scheme, where the turnaround stations each are a turnaround supporting station, a turnaround station away from an origin station has a high priority, and a turnaround station close to the origin station has a low priority;
- an affected train set generating unit M4, configured to generate an affected train set upon occurrence of the jam according to the jam position and the jam time;
- a time predicting unit M5, configured to predict, according to the affected train set, arrival times of each affected train at the turnaround stations of the different priorities;

a planned train service determining unit M6, configured to determine, according to the arrival time of each affected train at a turnaround station, a planned train service to be executed by the affected train after turning around; and a train resource allocating unit M7, configured to acquire a quantity of planned train service canceled during the jam, and allocate, according to the quantity of planned train service canceled during the jam, a train resource for train addition or storage.

As an optional implementation, the operation adjustment system for a metro train in a unidirectional jam according to the embodiment of the present disclosure further includes:

a train intermediate turnaround control unit, configured to schedule, the affected train to perform an midway turnaround at a station of a lower priority to execute another planned train service, when the affected train cannot execute a planned train service in an affected train number set after turning around at a turnaround station of a highest priority;

a detaining position determining unit, configured to determine a detaining position of a train on a non-routing line;

an extra passenger train departure interval control unit, configured to calculate a departure interval of an extra passenger train according to the jam position and the line topology information; and an extra passenger train running control unit, configured to run the extra passenger train to arrive at a station on the line, where a running routing cannot be formed, to carry passengers.

According to the operation adjustment method and system for a metro train in a unidirectional jam provided by the embodiments of the present disclosure, at the beginning of the jam, the present disclosure uses the intelligent method to replace the method that the dispatcher manually determines the train operation routing scheme in the jam, and omits the conventional complicated operation of manually determining the affected train one by one. In the process of the jam, the present disclosure intelligently determines the train detaining position on the metro line without the running routing, and makes the train clear the passengers at the station as much as possible, thereby preventing the adverse effect of section passenger clearing on the passengers. Meanwhile, the present disclosure calculates the departure interval with information such as the line topology and the station type, and reasonably adds the extra passenger train to arrive at the station on the line for passenger carrying, thereby preventing a phenomenon that a great number of passengers are stranded due to no trains for a long time, and improving the QoS for the passengers as much as possible. Upon the recovery of the jam, the present disclosure automatically allocates the train resource with the depot or the storage line of the station, which greatly reduces the complicated and frequent operation on the trains in dispatch and command process of the trains.

Since the system disclosed in the embodiments corresponds to the method disclosed in the embodiments, the description of the system is relatively simple, and reference can be made to the method for details.

In this specification, several specific embodiments are used for illustration of the principles and implementations of the present disclosure. The description of the foregoing embodiments is used to help illustrate the method of the present disclosure and the core ideas thereof. In addition, persons of ordinary skill in the art can make various modifications in terms of specific implementations and the scope of application in accordance with the ideas of the present disclosure. In conclusion, the content of this specification shall not be construed as a limitation to the present disclosure.

The above embodiments are provided merely for an objective of describing the present disclosure and are not intended to limit the scope of the present disclosure. The scope of the present disclosure is defined by the appended claims. Various equivalent replacements and modifications made without departing from the spirit and scope of the present disclosure should all fall within the scope of the present disclosure.

What is claimed is:

1. An operation adjustment method for a metro train in a unidirectional jam, the method comprising:

acquiring a jam position and a jam time;

generating a train operation routing scheme in the jam according to the jam position;

after generating the train operation routing scheme in the jam according to the jam position, processing a train on a non-routing line without the train operation routing scheme, the processing comprising:

determining a detaining position of the train on the non-routing line;

calculating a departure interval of an extra passenger train according to the jam position and line topology information; and running the extra passenger train to arrive at a station on the line, where routing is not formed, for passenger carrying;

setting priorities for turnaround stations on a routing according to the train operation routing scheme, wherein the turnaround stations each are a turnaround supporting station, a turnaround station away from an origin station has a high priority, and a turnaround station close to the origin station has a low priority;

generating an affected train set upon occurrence of the jam according to the jam position and the jam time;

predicting, according to the affected train set, arrival times of each affected train at the turnaround stations of the different priorities;

determining, according to the arrival times of each affected train at the turnaround stations, planned train service to be executed by the affected train after turning around; and acquiring a quantity of planned train service canceled during the jam, and allocating, according to the quantity of planned train service canceled during the jam, a train resource for train addition or storage.

2. The operation adjustment method according to claim 1, wherein the generating the train operation routing scheme in the jam according to the jam position comprises:

searching an available train running routing on two sides of the jam position according to the jam position and line topology information, the line topology information being information on a station position and a corresponding layout; and determining the train operation routing scheme according to the available train running routing, the train operation routing scheme comprising two cases, which are a case where two sides of the jam position each are provided with a running routing, and a case where only one side of the jam position is provided with the running routing, and an other side does not form the running routing.

3. The operation adjustment method according to claim 1, wherein the turnaround supporting station refers to a station enabling a train to switch terminals of the train and change a running direction;

a turnaround type comprises a midway turnaround and a terminal turnaround; the midway turnaround refers to a turnaround at an intermediate station; and the terminal turnaround refers to a turnaround at the destination station; and a turnaround mode comprises a platform-front turnaround and a platform-behind turnaround.

4. The operation adjustment method according to claim 1, wherein the predicting, according to the affected train set, arrival times of each affected train at the turnaround stations of the different priorities comprises:

predicting the arrival times of each affected train at the turnaround stations, according to basic information of each affected train including a present position, a velocity, a tractive force and a braking force, by using a section minimum running time model.

5. The operation adjustment method according to claim 1, wherein the determining, according to the arrival times of each affected train at the turnaround stations, planned train service to be executed by the affected train after turning around comprises:

determining, planned train service that are executed by the affected train in a present departure condition, by comparing a first time after the affected train arriving at a turnaround station on a preset routing and performing a normal turnaround with a time of a planned train service after the first time.

6. The operation adjustment method according to claim 5, wherein after the determining, according to the arrival times of each affected train at the turnaround stations, planned train service to be executed by the affected train after turning around, the method further comprises:

scheduling the affected train to perform a midway turnaround at a station of a lower priority to execute another planned train service, when the affected train does not execute a planned train service in an affected train number set after turning around at a turnaround station of a highest priority.

7. The operation adjustment method according to claim 1, wherein after the determining, according to the arrival times of each affected train at the turnaround stations, planned train service to be executed by the affected train after turning around, the method further comprises:

scheduling the affected train to perform a midway turnaround at a station of a lower priority to execute another planned train service, when the affected train does not execute a planned train service in an affected train number set after turning around at a turnaround station of a highest priority.

8. An operation adjustment system for a metro train in a unidirectional jam, comprising:

an information acquiring circuit, configured to acquire a jam position and a jam time;

a routing operation scheme generating circuit, configured to generate a train operation routing scheme in the jam according to the jam position;

a priority determining circuit, configured to set priorities for turnaround stations on a routing according to the train operation routing scheme, wherein the turnaround stations each are a turnaround supporting station, a turnaround station away from an origin station has a high priority, and a turnaround station close to the origin station has a low priority;

an affected train set generating circuit, configured to generate an affected train set upon occurrence of the jam according to the jam position and the jam time;

a time predicting circuit, configured to predict, according to the affected train set, arrival times of each affected train at the turnaround stations of the different priorities;

a planned train service determining circuit, configured to determine, according to the arrival times of each affected train at the turnaround stations, planned train service to be executed by the affected train after turning around;

a train resource allocating circuit, configured to acquire a quantity of planned train service canceled during the jam, and allocate, according to the quantity of planned train service canceled during the jam, a train resource for train addition or storage; and a train midway turnaround control circuit configured to schedule the affected train to perform a midway turnaround at a station of a lower priority to execute another planned train service, when the affected train does not execute a planned train service in an affected train number set after turning around at a turnaround station of a highest priority.

9. The operation adjustment system according to claim 8, further comprising:

a detaining position determining circuit, configured to determine a detaining position of a train on a non-routing line;

an extra passenger train departure interval control circuit, configured to calculate a departure interval of an extra passenger train according to the jam position and a line topology information; and an extra passenger train running control circuit, configured to run the extra passenger train to arrive at a station on the line, where a routing is not formed, for passenger carrying.

* * * * *